US011155971B2

(12) United States Patent
Tate

(10) Patent No.: US 11,155,971 B2
(45) Date of Patent: Oct. 26, 2021

(54) SYSTEM AND METHOD FOR CONSTRUCTING A CULVERT USING VEHICLE TIRES

(71) Applicant: Dakota Tate, Bluford, IL (US)

(72) Inventor: Dakota Tate, Bluford, IL (US)

( * ) Notice: Subject to any disclaimer, the term of this patent is extended or adjusted under 35 U.S.C. 154(b) by 0 days.

(21) Appl. No.: 16/900,706

(22) Filed: Jun. 12, 2020

(65) Prior Publication Data

US 2020/0392679 A1 Dec. 17, 2020

Related U.S. Application Data

(60) Provisional application No. 62/860,751, filed on Jun. 12, 2019.

(51) Int. Cl.
*E01F 5/00* (2006.01)

(52) U.S. Cl.
CPC ..... *E01F 5/005* (2013.01)

(58) Field of Classification Search
CPC ..... E01F 5/005; E02D 29/045
See application file for complete search history.

(56) References Cited

U.S. PATENT DOCUMENTS 4,006,678 A * 2/1977 Laurie ..... B65B 13/20 100/1
5,121,680 A * 6/1992 Nordberg ..... B65B 27/06 100/12
5,152,214 A * 10/1992 Nordberg ..... B30B 9/30 100/12
5,172,528 A * 12/1992 Clarke ..... E04B 1/00 428/903.3
5,178,489 A * 1/1993 Suhayda ..... E02B 3/06 405/21
5,236,756 A * 8/1993 Halliburton ..... E01F 5/005 156/95
5,238,228 A * 8/1993 Moon ..... E01F 15/145 256/1
5,347,919 A * 9/1994 Nordberg ..... B30B 9/30 100/12
5,366,323 A * 11/1994 Nicholson ..... E01C 11/227 405/119
5,718,166 A * 2/1998 Phillips ..... B65B 27/06 100/12
5,762,448 A * 6/1998 Bilanin ..... E02B 17/0017 405/73
5,915,880 A * 6/1999 Nordberg ..... E01F 5/005 138/155
6,604,888 B2 * 8/2003 Dolan ..... E01F 15/146 404/10
8,634,051 B1 * 1/2014 Shiban ..... E01F 15/003 352/202

* cited by examiner

*Primary Examiner* — Benjamin F Fiorello

(57) ABSTRACT

The method teaches constructing a culvert using discarded tires. The culvert's stress points are reinforced by truck tires. Additionally, the integrity of the culvert is kept intact using a predetermined formula for every 10 feet of culvert constructed.

16 Claims, 12 Drawing Sheets

SYSTEM AND METHOD FOR CONSTRUCTING A CULVERT USING VEHICLE TIRES

RELATED APPLICATION

The present invention claims priority to U.S. Provisional Application No. 62/860,751, which was filed on Jun. 12, 2019.

FIELD OF THE INVENTION

The present invention relates to a culvert for directing the flow of water. More particularly, the invention relates to a culvert using vehicle tires.

BACKGROUND OF THE INVENTION

The huge amount of solid waste generated from tires is a major concern. Discarded or used tires have a severe negative impact on the environment in terms of air, water, and soil pollution. For example, old tires contain heavy metals and chemicals which leach into the environment as the tire disintegrates. Such, "leaching" contaminates the soil and groundwater with poisons. Additionally, used tires overcrowd landfills, pose a fire risk because of the chemicals, and inhibit pest control by proving places for pests to hide and thrive.

Tire shredders are commonly used to minimize the effect of discarded used tires on the environment. Shredders are used, for example, when the shredded tire is recycled. However, shredding the tire does not reduce the effects the discarded tires may have on the environment. Contrarily, the shredded tire increases the surface area at which the shredded tire contacts the environment. Additionally, recycling efforts, though valiant, don't deplete the supply of used tires. Instead, used tires that are not recycled are left to harm the environment.

Other conventional methods for managing discarded used tires involve repurposing the tires. For example, U.S. Pat. No. 5,236,756, entitled "Drainage Culverts Made of Sidewalls From Discarded Tires," issued Aug. 17, 1993 to Haliburton (the '756 patent), teaches discarding the tire treads and using the remaining tire sidewalls to construct a culvert. At least two tire sidewalls are laid flat together and are drilled with holes that allow the tire sidewalls to be mounted on parallel bars, which have been welded to a circular plate of roughly the same dimensions as the tire sidewalls. According to the '756 patent, a culvert may be created when 50 to 150 of such tire sidewalls have been mounted on the parallel bars. The '756 patent cuts off any protruding portion of the welded bars to complete the culverts construction.

Unfortunately, the '756 patent is deficient in that the method taught does not use the tire treads in its construction of culverts. Instead, the tire treads are left to be recycled. As aforementioned, unused tires, and tire portions, are left to further damage the environment.

U.S. Pat. No. 5,718,166, entitled "Method for making Pipe Made of Discarded Vehicle Tires, issued Feb. 17, 1998 to Phillips (the '166 patent) teaches a method for making a culvert using old tires. According to the '166 patent, an apparatus is provided that includes a telescoping mandrel having a first a second spaced apart compactor plates for mounting tires there between. The '166 patent teaches a plurality of spearheaded plungers mounted on the second compactor plate for puncturing holes through the sidewalls of the tires. A telescoping mandrel is used to hold tires of the same rim size in alignment and for use in loading batches of compressed tires.

By using the entire tire, the '166 patent avoids the problems posed by leftover (ie. unused and unrecycled) tire material, such as is taught in prior arts like the '752 patent. However, the '166 patent has a major drawback in that it uses specialized machinery often unavailable to the rural culvert manufacturer because of, for example, cost, or, the shear unavailability of the equipment in a rural environment.

What is needed is an accessible and environmentally safe system and method for creating a culvert using discarded or used vehicle tires.

SUMMARY OF INVENTION

The present invention teaches improvements not found in the prior art. The present invention teaches a system and method for creating a culvert using discarded or used tires. The method taught herein uses a combination of steps that avoids the problems associated with leftover tire material. The steps disclosed herein reduce the costs of creating tire culverts, above what is found in the prior art.

In one aspect, the method of the present invention teaches ensuring the tires used in the construction of the culvert are suitable for placing back into the environment. A tire that is suitable for placing back into environment is one wherein the effects of the tire on the environment has been reduced before the tire in placed in use in the environment.

In another aspect of the invention, the method of the present invention teaches constructing a culvert according to the traffic the culvert will bear.

In still another aspect, the method of the present invention teaches reducing the number of tires used in the construction of a culvert by specifically determining the number of tires to be used.

BRIEF DESCRIPTION OF THE DRAWINGS

A more complete understanding of the present invention may be derived by referring to the various embodiments of the invention described in the detailed description of the invention and the drawings and figures, in which like numerals denote like elements. In the drawing figures.

Figure 1:
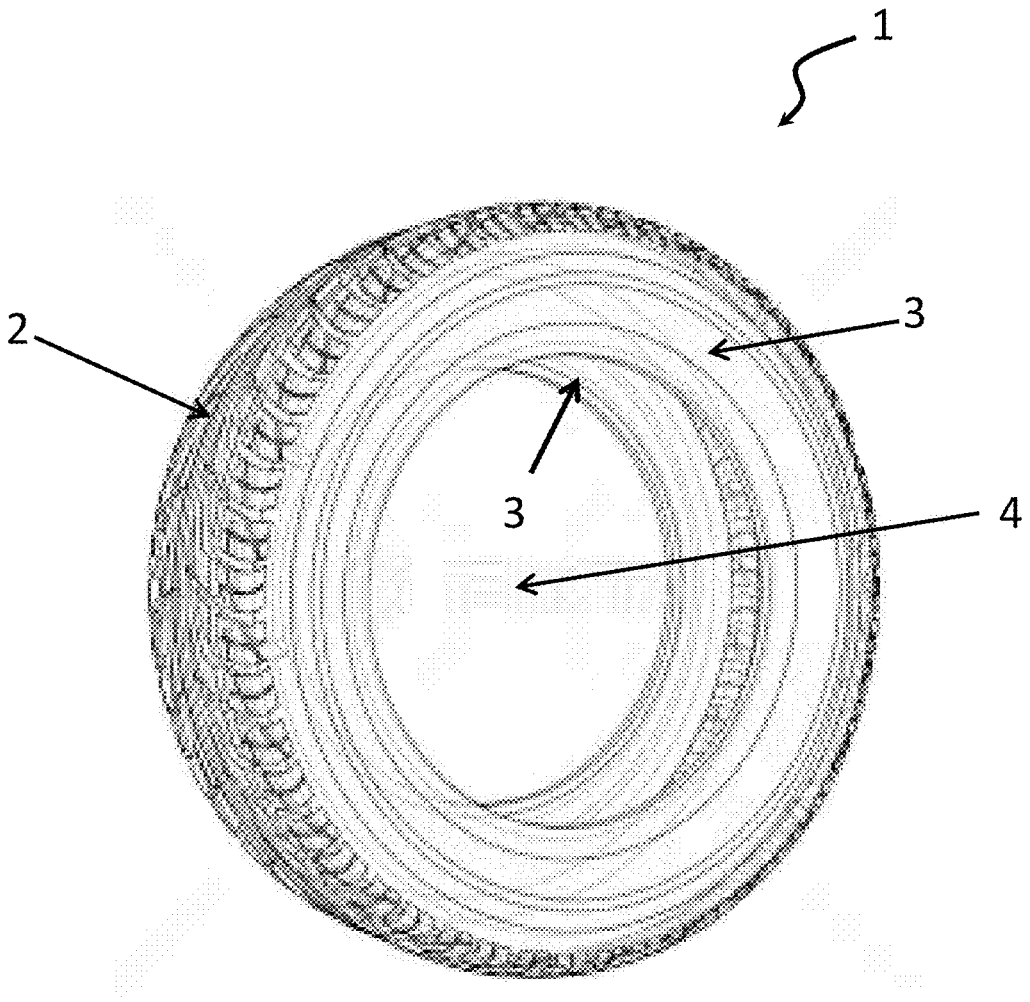
FIG. 1 is an exemplary illustration of a conventional discarded or used tire that is useful with various embodiments of the present invention.

While the disclosure is amenable to various modifications and alternative forms, specific embodiments have been shown by way of example in the drawings and are described in detail below. The intention, however, is not to limit the disclosure to the particular embodiments described. On the contrary, the disclosure is intended to cover all modifications, equivalents, and alternatives thereof.

DETAILED DESCRIPTION OF PREFERRED EMBODIMENTS

FIG. 1 is an exemplary illustration of a conventional discarded or used tire 1 that is useful with various embodiments of the present invention. As shown, used tire 1 may be any convention tire found on passenger vehicles. Preferably, tire 1 does not include a tire rim. Instead tire 1 includes a central axis 4, the perimeter of which is formed by sidewalls 3. As is well known, tire 1 has sidewalls 3 on both the left and right side of tire 1. Further still, tire 1 includes tire treads 2. Conventional definitions of a tire 1, tire sidewalls 3, tire tread 2 are well understood by those skilled in the tire art. As such, tires and their components are well understood, and will not be discussed herein for brevity. Suitable tires are those that are used with any vehicle for transporting passengers. In one preferred embodiment, tire 1 is one used on conventional passenger cars, or trucks, used on roadways.

The present invention may discuss a tire or tires. It should be noted that the terms tire and tires are used interchangeably, where appropriate. That is, in some instances, where "tire" is used, it will be apparent that the use of tire, means a single tire, and such use of tire is appropriate to one skilled in the art. Alternatively, where "tires" is used herein, it will be apparent to those skilled in the art that the use of tires may refer to a plurality of tires.

Figure 11A:
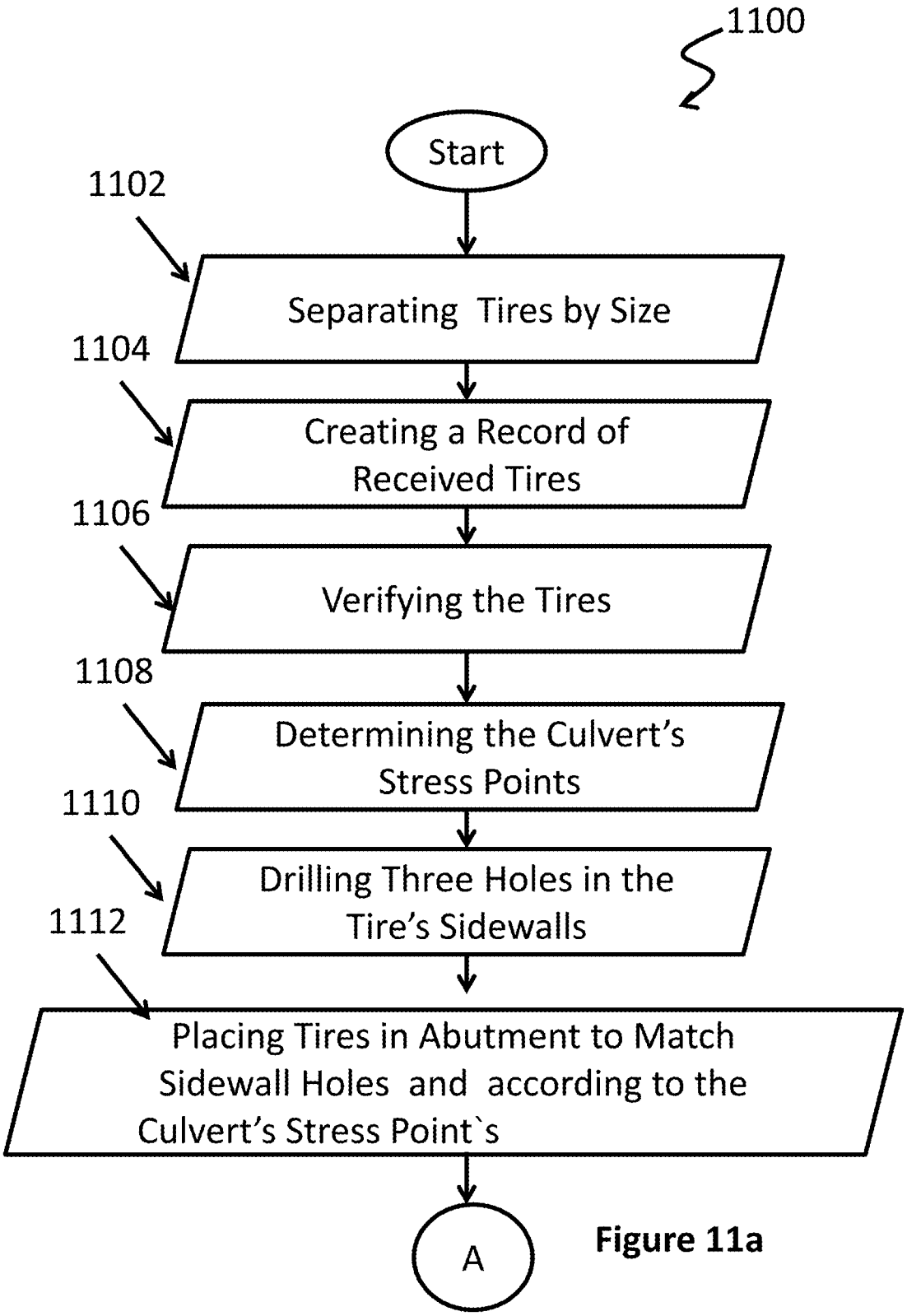
FIGS. 11*a* and 11*b* are depictions of an exemplary method of creating a tire culvert according to various of the present invention.
Figure 11B:
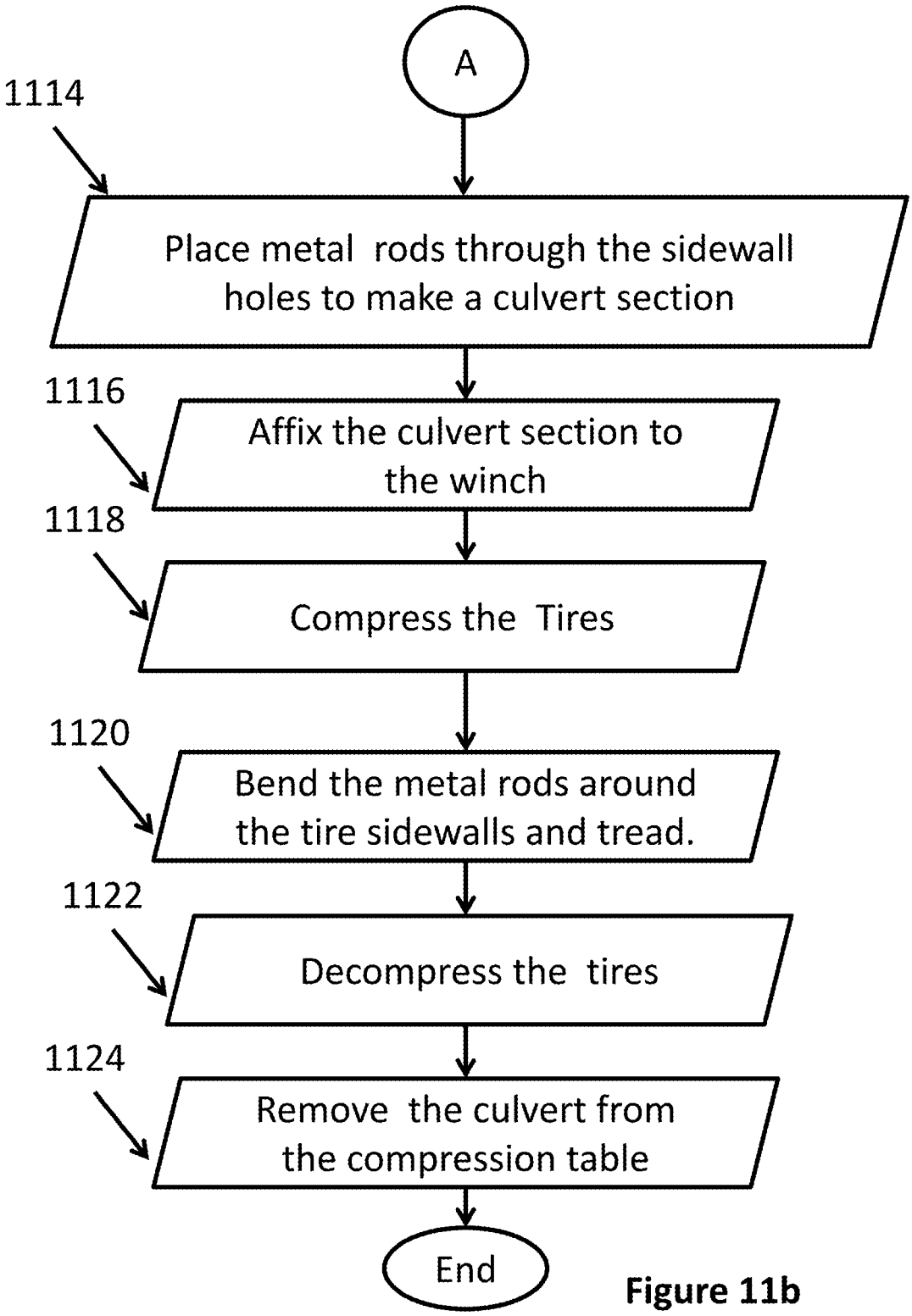

FIG. 11*a*-and FIG. 11*b* are an exemplary illustration of the preferred and exemplary method 1100 of creating a culvert using discarded or used tires, according to various embodiments of the present invention. Method 1100 may include separating discarded tires 1 into stacks according to the rim size of the tire 1. It is well known that each conventional tire 1 is designed be mounted onto a vehicle rim (not shown). When tire 1 is mounted on a rim, the rim is inserted in the tire central axis 4.

Further, each conventional tire 1 may be characterized, at least in one aspect, by the size of the rim on which tire 1 is mounted. For example, when a tire 1 is mounted on a thirteen inch (13") rim, then tire 1 may be characterized as a 13" tire. Similarly, where a tire 1 is mounted on a fourteen inch (14") rim and the tire may be called a 14" tire. In this example, the 13" tire is smaller in circumference and diameter to that of the 14" tire. Naming conventions for tires 1 that include the size of the rim on which tire 1 is mounted are well known, and will not be repeated herein for brevity.

With reference to FIG. 11*a*, method 1100 may include separating tires 1 according to the tire size (e.g., rim size) (Step 1102). A user practicing the method 1100 may create a record of tires received for use in the present invention (Step 1104). In one particular embodiment, the created record includes tracking at least one of the number of tires 1 of each size, and condition (i.e., level of wear, whether or not the tire is intact, etc.) of the tires 1 of each size.

In accordance with one embodiment of the invention, the record may be stored in a computer readable medium, and accessed and by processed by computing equipment. Such, methods of storing and processing records is well known. Such conventional computing methods may be used with the present invention.

Method 1100 may include an analysis of the culvert. For example, analyzing the environment in which the culvert may be used, or measuring the length of the culvert, or determining the culvert's "stress point." As used herein, a culvert stress point is one of the locations on the external surface of the culvert where the greatest external pressure is to be exerted. By way of example, where the culvert is to be placed underneath a public roadway, the culvert stress point may be determined to be the locations on the culvert that will receive the greatest pressure when a vehicle transverses the roadway.

In a typical exemplary embodiment, the stress point is the location, section or portion on the culvert that bears the weight of the vehicle. It is well known that the weight of a vehicle rests on its tires. In one exemplary embodiment, a culvert's stress point is the area on the culvert's outer surface that is closest to the area of the public roadway contacting the vehicle tires, when the vehicle is transgressing above the culvert. In some instances, the culvert's stress point is the area of the culvert contacting the vehicle tires that are transgresses over the area of the culvert experiencing the most downward pressure. As used herein, "contacting" may mean direct contact, or indirect contact (i.e., contact through a transfer of the contacting force through another object.)

Figure 2:
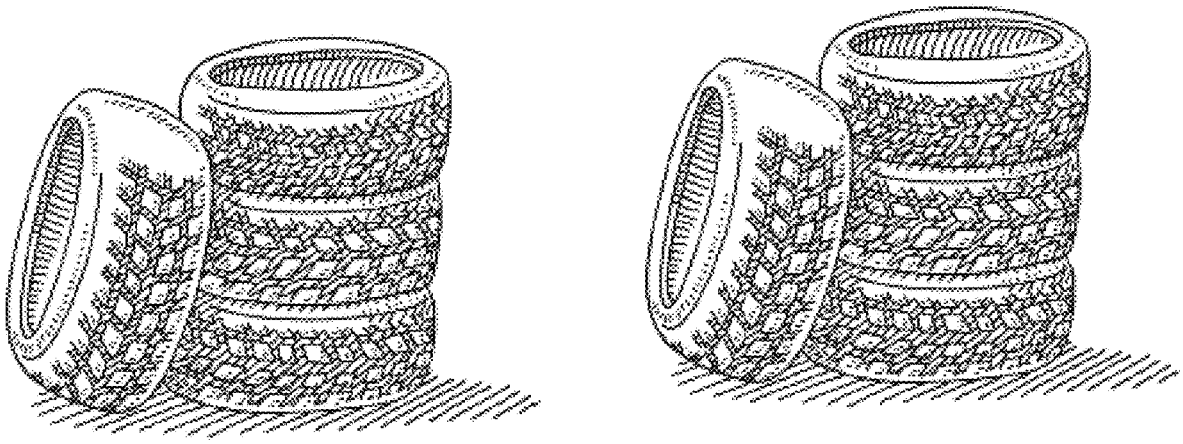
FIG. 2 is an exemplary illustration of verified discarded or used tires that is useful with various embodiments of the present invention.
Figure 3:
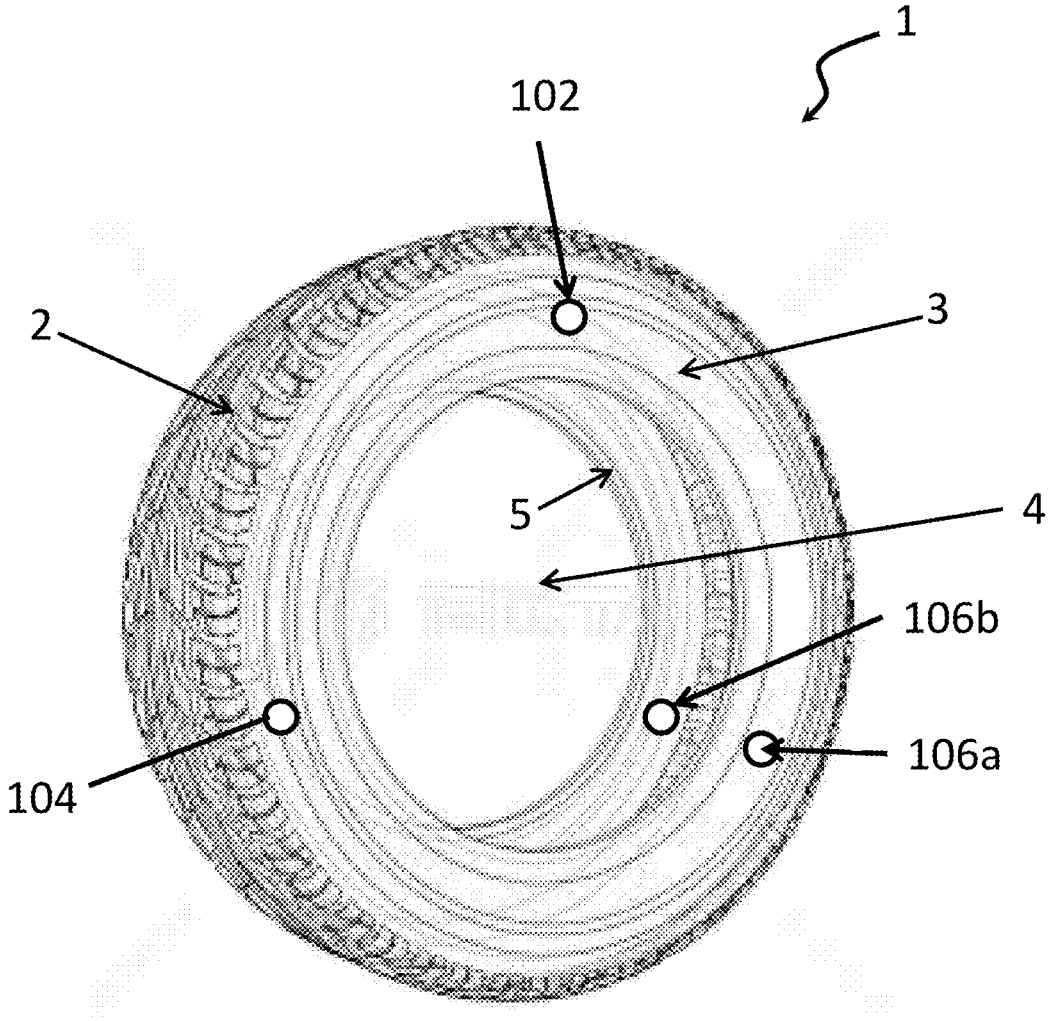
FIG. 3 is an exemplary illustration of a conventional discarded or used tire that is useful with various embodiments of the present invention, wherein the post locations are illustrated.

The stacked vehicle tires (FIG. 2 showing Stack A including tires of different size that are shown in Stack B) may be verified. (Step 1106) Verification of the tires includes comparing the number and condition of the stacks with the record of received tires. The number of tires and the condition of the tires are compared against the number and condition of the tires noted in the record of tires created in step 1104.

As used here, verification of the tires includes removing all chemicals, or particles that may damage the environment and determining if the tire 1 has sufficient physical structure to withstand external force. For example, tires 1 that have lost their tread 2 or have holes in the sidewalls 3 will be discarded and not used in the culvert. Any tires 1 that have lost their structural integrity will also be discarded and not used in the culvert.

Prior to creating the culvert, the area in which the culvert is to be used must be analyzed to determine the culvert's stress point(s). (Step 1108) In one particular embodiment of the invention, determining the culvert's stress point includes measuring the length of the area in which the culvert is to be installed. Then, where the culvert is to be used along the width of a roadway, the location on the culvert over which a vehicle's tires will traverse is approximated.

The culvert created according to the present invention, includes boring three (3) equidistant holes 102, 104, 106(*a*, *b*) in each of tires 1 selected from any one of the stacks of vehicle tires. (Step 1110) Holes 102, 104, 106(*a*, *b*) are bored in the sidewalls 3, 5 of each tire 1. Hole 106*a* in a first sidewall 3 shares the same central axis as hole 106*b* in sidewall 5. Further still, each of holes 102, 104, and 106(*a, b*) are drilled with the same circumference.

Holes 102, 104, 106 (*a, b*) may be formed in side walls 3, 5 using any suitable method such as drilling or punching. This can be done by hand, using a hand-held drill and a template to align the holes properly through the sidewalls 3, 5. Alternatively, holes 102, 104, 106(*a, b*) may be form using a manufacturing jig, which involves making holes 102, 104, 106 (*a, b*) simultaneously, using a plurality of the same size drill bits. The operation of drills and punches is well known. As such, the operation of each is not described herein for brevity. Suffices to say that whether drilling or punching is used, the operation removes a small piece of material from each hole 102, 104, 106(*a, b*) location.

It is well known that tires of different sizes are made to bear different amounts of weight. Smaller tires are made to sustain the weight of smaller cars. For example, a 13" tire is made to bear the weight of the average conventional passenger vehicle. Similarly, a 16 truck tire is made to bear the weight of the conventional passenger truck. The present invention takes advantage of this structural difference, and the weight bearing differences in the tire sizes.

In one exemplary embodiment, the culvert of the present invention is constructed such that a truck tire (T) is placed in the construction of the culvert directly under the area of the road where the tire would traverse. These are the areas of the roadway bearing the most weight. These areas correspond to the stress points on the culvert (i.e., traditional stress points). The areas of the roadway where the tires do not traverse bear less weight than at the stress points. As such, car tires (C) are placed in the construction of the culvert where the stress points do not appear.

In another exemplary embodiment, the culvert according to the present invention is constructed such that truck tires, T, and car tires, C, are ordered according to the length of the culvert. For example, according to the present invention, every 10 feet of the culvert may be constructed with the tires 1 arranged according to the following formula, where T represents the location of the truck tires and C represents the location of car tires:

TC, TCC, TCCC, TCCCC, TCCCCC, TCCCCCC, TCCCCC, TCCCC, TCCC, TCC, TC.

In this arrangement, the entire length of the culvert is made to withstand the stress imposed by vehicle traffic should a vehicle traverse the culvert at a nontraditional stress point.

Consequently, upon arranging the tire according to the methods noted above to address the culvert's stress points, metals rods 200, such as shown in FIG. 2, may be inserted in holes 102, 104, 106(*a, b*) to construct the culvert. Specifically, tires 1 are placed in abutment one next to the other according to where the user determines that the stress points will appear on the culvert. (Step 1112) Once tires 1 are placed in abutment, tires 1 may be further arranged such that the holes 102, 104, 106(*a, b*) to the corresponding holes in an abutting tire.

Figure 4:
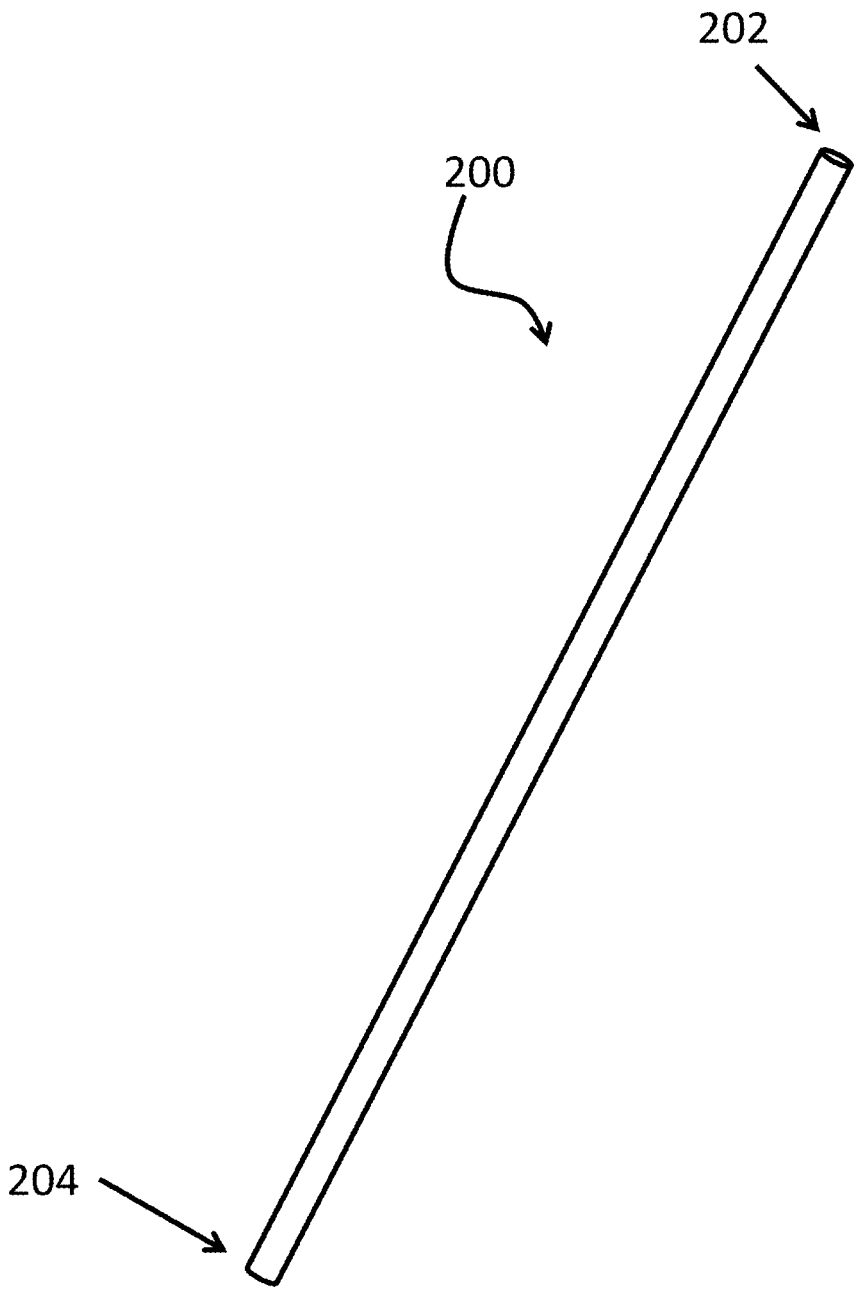
FIG. 4 is an exemplary illustration of a metal rod that may be used with exemplary embodiments of the present invention.

As noted, the present invention uses 3 metal rods 200 inserted into holes 102, 104, 106(*a, b*). Metal rods 200 are constructed with a first rod end 202 and a second rod end 204, where first rod end 202 is distal from second rod end 204. (See FIG. 4) As used herein, the term rod is used to refer to a relatively rigid stiff elongated component that will pass through holes 102, 104, 106(*a, b*). No specific type of cross-section of metal rods 200 is required. However, a circular cross-section may be used in the preferred embodiment of the invention. In one exemplary embodiment, metal rods 102 are comprised of steel. That is, in an exemplary embodiment, with reference to FIG. 11*b*, the user continues construction of the culvert by placing metal rods 202 through the sidewall holes 102, 104, 106(*a, b*). (Step 1114)

Figure 5:
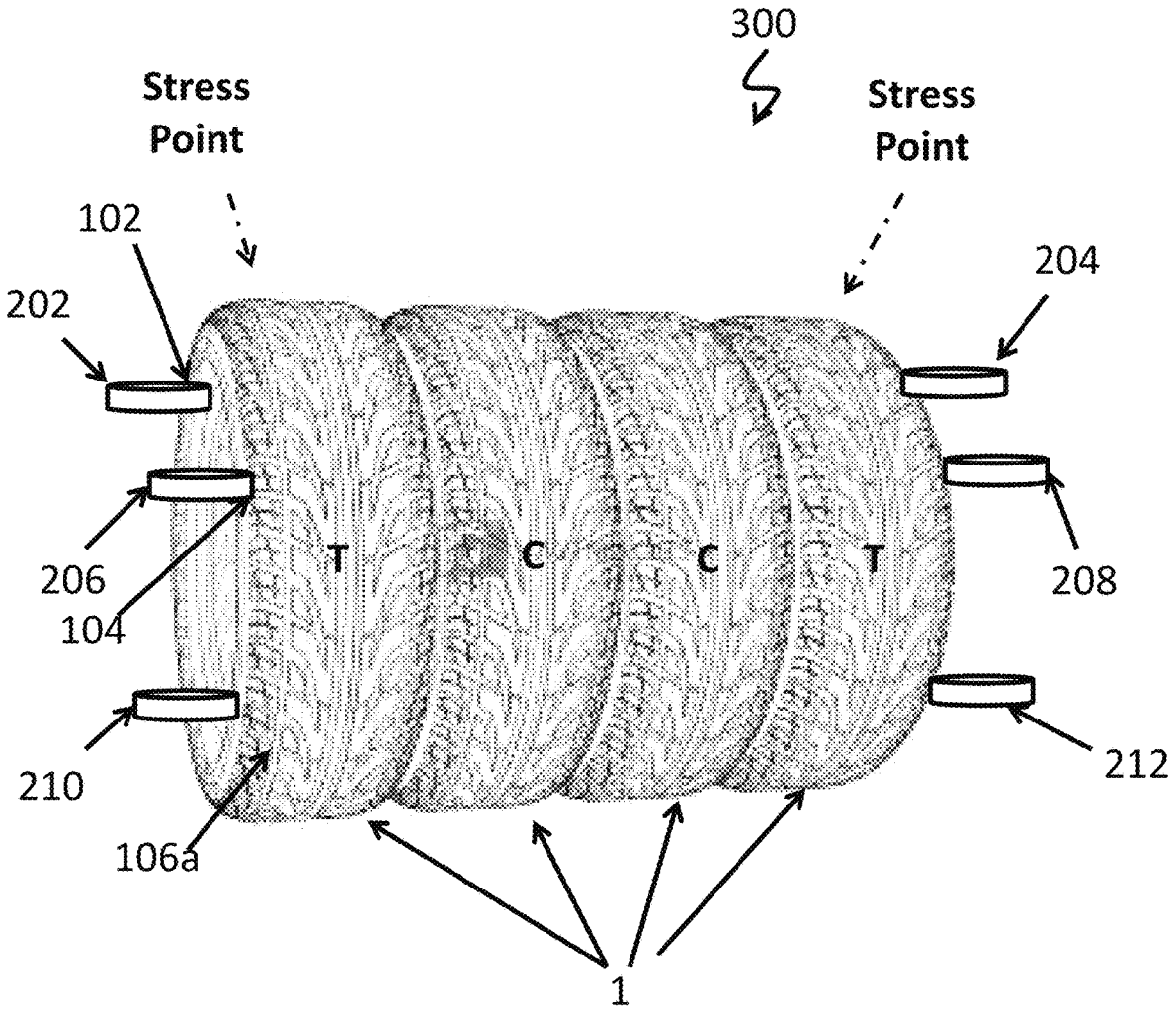
FIG. 5 is an exemplary illustration of a section of a culvert made with discarded or used tires according to various exemplary embodiments of the present invention, wherein the tires are illustrated affixed to the metal rods.

With reference to FIG. 5, a culvert section 300 is shown wherein tires 1 are placed in abutment in the following arrangement: TCCT, wherein the culverts stress points are supported by truck tires, T. As noted above, metal rods 202, 204, 206 are inserted into the corresponding holes 102, 103, 106(*a, b*) of tires 1. Metal rods 202, 204, 206 have the same description as metal rod 200.

Figure 6:
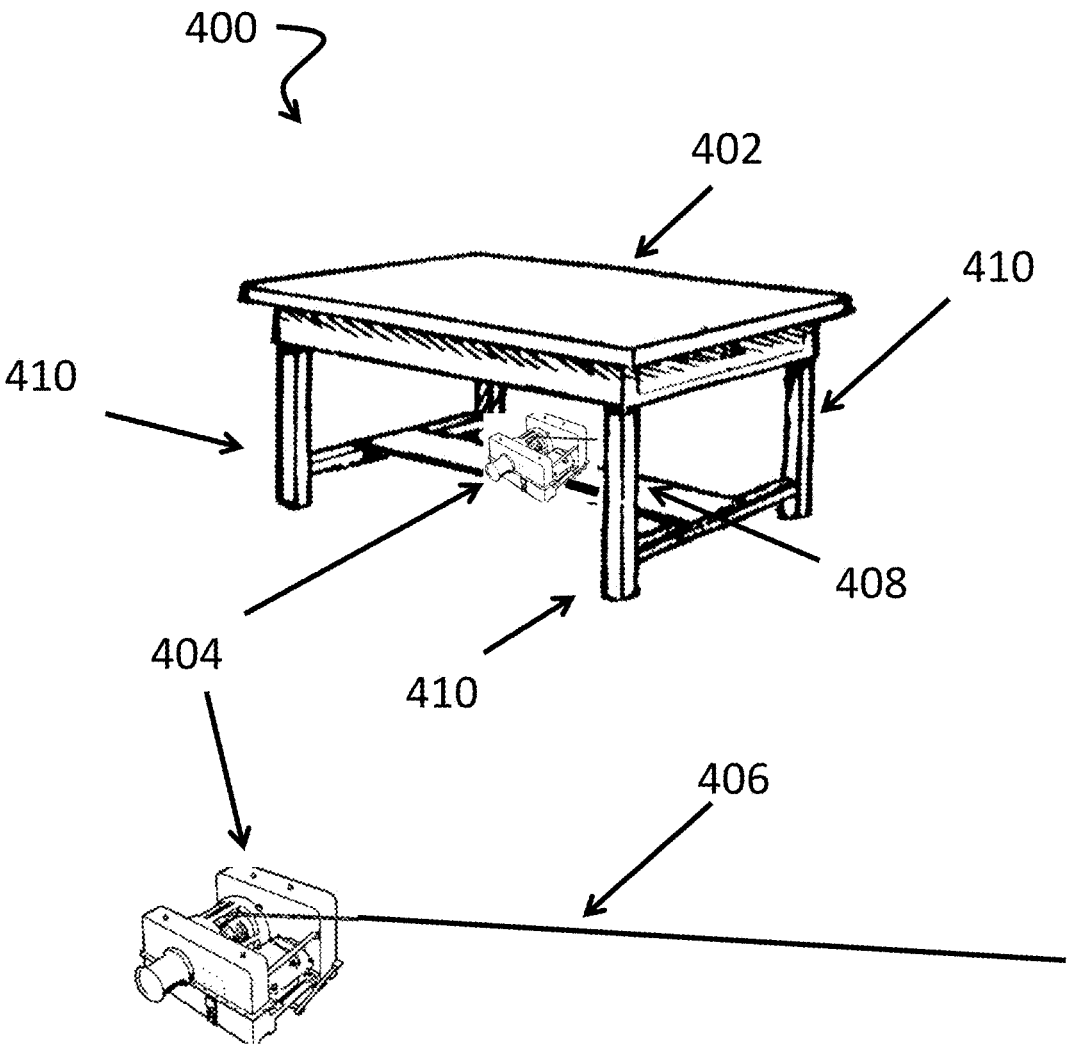
FIG. 6 is an exemplary press table used to compress rodded discarded or used tires according to various exemplary embodiments of the present invention.

A compression table 400 may be used to compress tires 1 in culvert section 300. Compression table 400 may be any conventional table on which a wench 404 may be attached. In the embodiment shown in FIG. 6, compression table 400 is a conventional table having an upper planer surface 402, supported by table legs 410, and including a planar support beam 408 adjoining table legs 410. Planar support beam 408 may be such that it further supports affixing a wench thereto.

In a typical example of the invention, wench 404 may be a conventional cable wench. A suitable cable wench that may be used with the present invention may pull 3,000 ft lbs having a 5.4 horsepower engine. The wench cable may be any conventional cable 406 that is used with such wenches. Such cables and cable wenches are well known by those skilled in the art.

Figure 7:
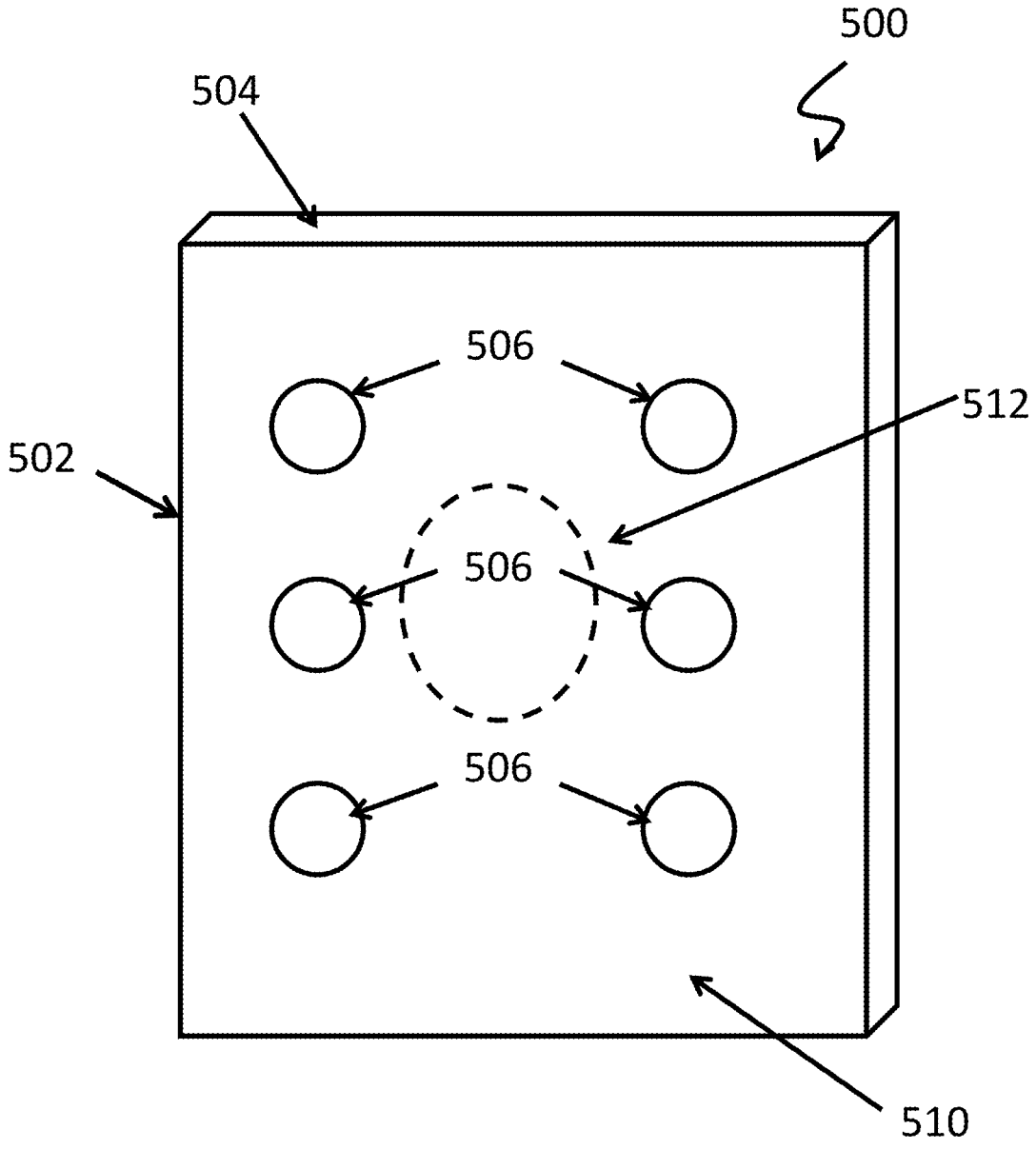
FIG. 7 is an exemplary illustration of a press plate according to various exemplary embodiments of the present invention.

In a typical embodiment of the invention, the end of the cable 406 distal from the wench 404 is affixed to a compression plate 500, as shown in FIG. 7. Compression plate 500 may be comprised of ¼" steel plate. More particularly, compression plate 500 may be comprised of ¼" steel plating off a combined throat.

Compression plate 500 may be any shape that can support at least one end of culver section 300. In one exemplary embodiment compression plate 500 may have a first top edge 504, and side edges 502. Compression late 500 may further include multiple holes 506, formed through the compression plate planar surface 508. In one particular embodiment, holes 506 may be used at as attachment point for cable 406

Figure 8:
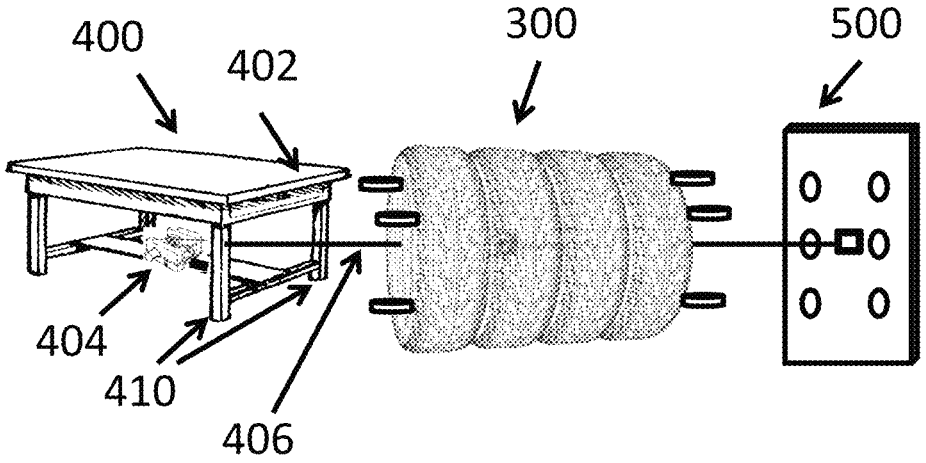
FIG. 8 is an exemplary illustration of a press table according to exemplary embodiments of the present invention, pressing the discarded or used tires into a culvert.

FIG. 8 shows compression plate in operation, wherein culvert section 300 may be compressed according to various embodiments of the present invention. As shown, Culver section 300 is placed in abutment with compression table 400, such that the tire 1, sidewall 3 that is closest to compression table 400 abuts against planar surface 402. In alternate embodiments of the invention, culvert section 300 may abut against table legs 410. (Step 1116)

Wench cable 406 may be positioned through the center of culvert section 300 and parallel to the tire central axis 4. Cable 406 may be removable affixed to compression plate, such as by screwing or hooking the cable to the center mass 512 of compression plate 500. Conventional methods of attaching a winching cable 406 to an object are well known, and therefore will not be discussed herein for brevity. It should be noted, that according to the invention, cable 406 may be removed from compression plate 500 once culvert section 300 tires are compressed together.

During operation, wench 404 is turned on, which in turn, pulls compression plate 500 against the culvert section 300, to pull culvert section 300 closer to compression table 400, thereby compressing tires 1. (Step 1118) This action compresses the abutting tires 1 against each other. The compression of the abutting tires 1 causes the sidewalls 3, 5 to seal together against the abutting tire sidewalls. In this instance, by seal what is meant is that the abutment of a first sidewall of a first tire is affixed to the first sidewall of a second tire. By seal, the abutting tires may prevent water from flowing between them.

This seal ensures that the culvert maintains it shape and structural integrity for supporting traversing vehicles, and for maintaining the flow of water in the culvert. That is, once tires 1 are compressed one to the another, the seal created by the sidewalls 3, 5 ensures that no liquid ore particles may enter or leave the central portion of culvert section 300 along culvert 300's central axis. Compressing the tires also leaves metal rod 200 ends exposed for manipulation.

Figure 9:
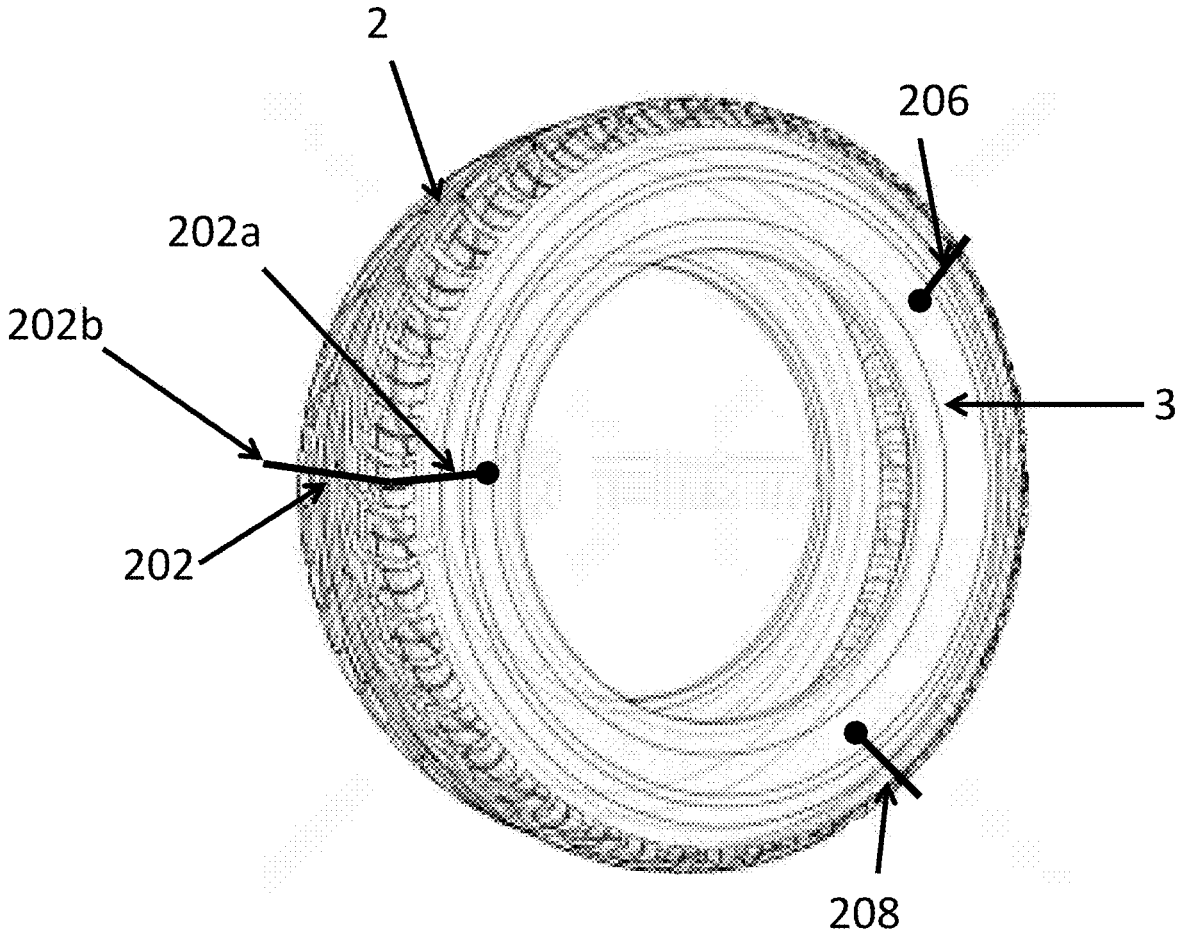
FIG. 9 is an exemplary illustration of a first end of a culvert, wherein the metal rods are shown bent over the tire treads.

The compressed tires 1 are held in the compressed state by bending the exposed metal rods 200 that have been inserted through holes 102, 104, 106(*a, b*). As shown in FIG. 5, each of the metal rods has a metal rod first rod end 202, 206, 210 and a corresponding metal rod second end 204, 208, 212 that is distal from the first rod end 202, 206, 210. With reference now to FIG. 9, upon compressing tires 1, metal rod first end 202, 206, 210 is bent first parallel to sidewall 3, and then further bent such that it is parallel tire tread 2. More particularly, metal rod first end 202 is first bent such that a portion of first end 202*a* of first end 202 abuts sidewall 3. Metal rod first rod end 202*a* may then be further bent to produce a first end rod portion 202*b*, that is positioned overlaying tire tread 2 and parallel to central axis 4.

Figure 10:
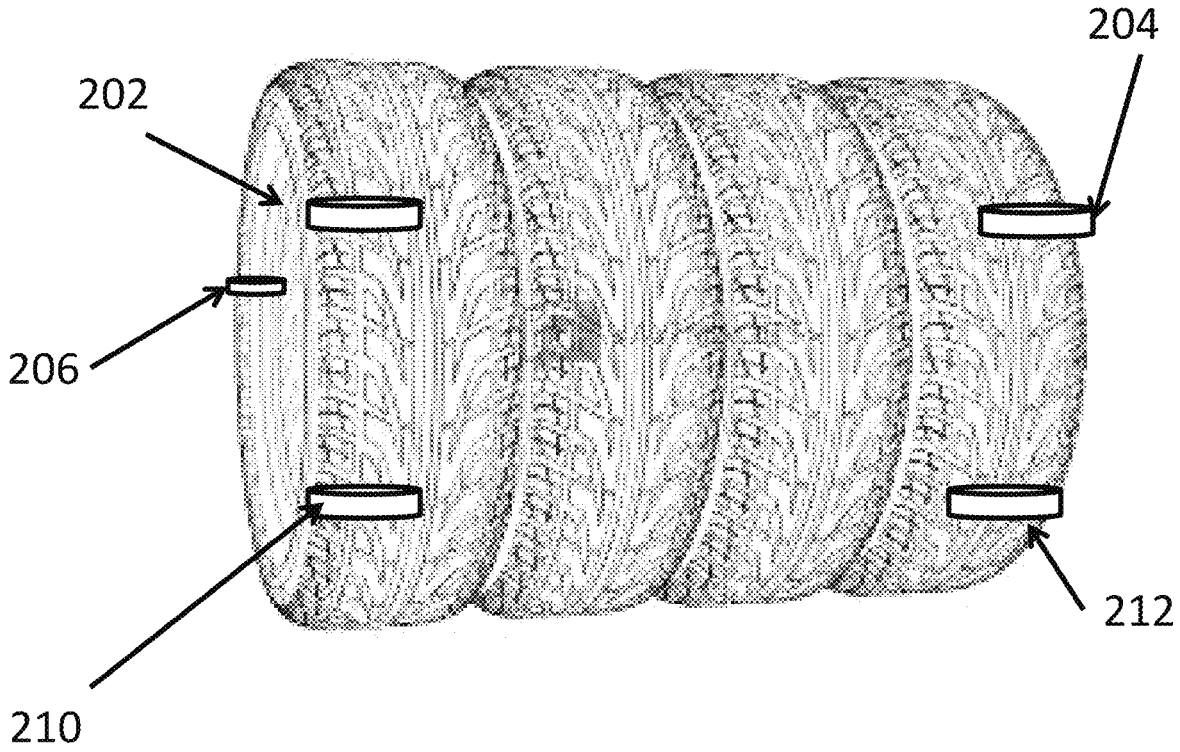
FIG. 10 is an exemplary illustration of a tire culvert in accordance with various embodiments of the present invention.

Each of the three metal rods 200 inserted in the holes 102, 104, 106(*a, b*) and used in the construction culvert section 300 is bent in the manner described above. That is, each of metal rod first rod end 202, 206, 210 is first bent to be parallel to sidewalls 3, 5 and then, secondly bent to be parallel to the tire tread and the central axis 4. Similarly, since each of the metal rods 200 also includes a metal rod second rod end 204, 208, and 212. As such, the second rod ends 204, 208, and 212 may be bent in similar manner as is described with respect to first rod end 202, 206, 210. That is, a first portion of second rod end 204, 206, 210 may be first bent parallel to sidewalls 3, 5, and then further bending second rod end 204, 206, 210 to be parallel to tire tread 2 and parallel to central axis 4. (Step 1120) (See, FIG. 10)

To further ensure that the tire 1 remain sealed one against the other, the tires are then decompressed only marginally since the bent metal rods 200 maintain the abutment of the tires. However, decompressing the tires also ensures that the tire sidewalls abut firmly to the bent portions (202*a* and 202*b*) to the tire sidewalls 3. (Step 1122)

In one exemplary embodiment, it may be necessary for at least one of the metal rod second rod ends 204, 208, 212 to be held in fixed position while compressing the tires 1, as was described with respect to Step 1118. In such an instance, a second rod end 204, 208, 212 may be placed abutting compression plate surface 510 during culvert section 300 compression. More preferably, second rod end 204, 208, 212 may be placed abutting compression plate surface 510 by in close proximity to one of compression plate holes 506. In such a way, once compression is complete, compression plate 500 may be rotated slightly to allow second rod end 204, 208, 212 to match up with one of compression plate holes 506, thereby allow second rod end 204, 208, 212 to be bent as described above, Specifically, a first portion of second rod end 204, 206, 210 may be first bent parallel to sidewalls 3, 5, and then further bending second rod end 204, 206, 210 to be parallel to tire tread 2 and parallel to central axis 4.

Once culvert section 300 is compressed, and the metal rods are bent as described above, the structural integrity of culvert section 300 is assured. That is, tires 1 are firmly held in abutment one to the other. The user may then, turn off the winch 404 releasing the compressing pressure on culvert section 300. The user may then remove cable 406 from its attachment at the center mass of compression plate 500, and remove the culvert from the compression table. (Step 1124) A culvert prepared accord to the methods described herein is ready for installation.

While the above description provides a full and complete disclosure of the preferred embodiments of the present invention, various modifications, alternate constructions and equivalents may be employed without departing from the true spirit and scope of the invention. Such changes may involve alternate components, structural arrangements, operable features or the like. Therefore, the above description and accompanying illustrations should not be construed as limiting the scope of the invention which is defined by the appended claims.

I claim:

1. A method for constructing a culvert of length, l, having a central axis, the culvert made of discarded vehicle tires, the vehicle tires having a first sidewall, a second sidewall and tire treads, the culvert comprising the steps of:

a. separating and stacking a plurality of discarded vehicle tires according to rim size, wherein the plurality of discarded tires includes at least one tire having a first rim size and a at least a second tire having a second rim size, wherein the first rim size has a greater circumference than the second rim size, b. creating a record of the plurality of discarded vehicle tires, wherein the record includes recording the condition of each one of the plurality of discarded tires, c. verifying the discarded tires, d. determining a stress point of the culvert, e. drilling three holes in the first sidewall of each of the plurality of discarded vehicle tires, wherein each hole is positioned equidistant from the other, f. drilling three holes in the second sidewall of each of the of the plurality of discarded vehicle tires, wherein each hole is positioned equidistant from the other, g. aligning the plurality of discarded vehicle tires from a first discarded vehicle tire to a last discarded vehicle tire, such that each one of the plurality of discarded vehicle tires is in abutment with at least one other of the plurality of discarded vehicle tires, wherein the central axis of each one of the plurality of discarded vehicle tires is parallel to the central axis of the culvert, and wherein the holes in each sidewall of each one of the plurality of discarded tires are matched with the holes in another one of the plurality of discarded tires, wherein a first discarded vehicle tire is positioned at a first end of the ordered plurality of discarded vehicle tires, wherein a second discarded vehicle tire is positioned at a second end of the ordered plurality of discarded vehicle tires, the first end of the ordered plurality of discarded vehicle tires being opposite the second end of the ordered plurality of discarded vehicle tires, and wherein at least one of the plurality of discarded tires is positioned at the culvert stress point, h. placing a first metal rod through at least one of the three holes drilled in the first sidewall of each one of the plurality of discarded vehicle tires, placing the first metal rod through at least one of the three holes drilled in the second sidewall of each one of the plurality of discarded vehicle tires, i. placing a second metal rod through at least one of the three holes drilled in the first sidewall of each of the plurality of discarded vehicle tires, placing the second metal rod through at least one of the three holes drilled in the second sidewall of each one of the plurality of discarded vehicle tires, j. placing a third metal rod through at least one of the three holes drilled in the first sidewall of each of the plurality of discarded vehicle tires, placing the third metal rod through at least one of the three holes drilled in the second sidewall of each of the plurality of discarded vehicle tires, k. placing a support plate in abutment with the second sidewall of the second discarded vehicle tire, wherein the support plate is positioned to allow free movement of the second exposed first metal rod end through the at least one of the three holes drilled in the second sidewall of the second tire, wherein the support plate is positioned allow free movement of the second exposed second metal rod end through the at least one of the three holes drilled in the second sidewall of the second tire, and wherein the support plate is positioned to constrict the free movement of the second exposed third metal rod end through the at least one of the three holed drilled in the second sidewall of the third tire, l. affixing a first end of a wench cable to the support plate, wherein the first end of the wench cable is connected to the center mass of the support plate, and wherein the second end of the wench cable is attached to a wench, and wherein the wench cable is positioned parallel to the axis of the culvert, wherein the wench is affixed to a compression table, m. placing the first sidewall of the first discarded vehicle tire in abutment with compression table, n. compressing the first sidewall of the first discarded vehicle tire to the compression table, o. compressing the second sidewall of the first discarded vehicle tire against the first sidewall of the second tire, such that the second sidewall of the first tire creates a seal with the first sidewall of the second tire, p. bending the first exposed end of the first metal rod, such that the first exposed end of the first metal rod is bent parallel to the first sidewall of the first discarded vehicle tire to create a first metal rod first end sidewall constraint, q. bending the first metal rod first end sidewall constraint to be parallel to the first discarded vehicle tire treads, r. bending the second exposed end of the first metal rod, such that the second exposed end of the first metal rod is bent parallel to the second side wall of second discarded vehicle tire to create a first metal rod second end sidewall constraint, s. bending the first metal rod second end sidewall constraint to be parallel to the second discarded vehicle tire treads, t. bending a first exposed end of the third metal rod, such that the first exposed end of the third metal rod is bent parallel to the first sidewall of the first discarded vehicle tire to create a third metal rod first exposed end sidewall constraint, u. bending the third metal rod first exposed end sidewall constraint to be parallel to the first discarded vehicle tire treads, v. rotating the compression plate to allow free movement of the second exposed end of third metal rod, w. bending a second exposed end of the third metal rod, such that the second exposed end of the third metal rod is bent parallel to the second side wall of the second discarded vehicle tire to create a third metal rod second end sidewall constraint, x. bending the third metal rod second end sidewall constraint to be parallel to the second discarded vehicle tire treads, y. decompressing the first discarded vehicle tire and the second discarded vehicle tire by releasing pressure on the wench cable, z. disconnecting the wench cable from the compression plate.

2. The method of constructing a culvert according to claim 1, wherein the first tire is positioned in the culvert according to the culvert's stress point.

3. The method of claim 1, wherein a multiple of the plurality of the discarded tires are truck tires, T, and wherein a multiple of the plurality of discarded tires are car tires, C, and wherein the plurality of discarded tires are placed in abutment in a predetermined sequence of abutting truck tires, T, and car tires, C, when the length of the culvert is at least 10 feet long.

4. The method of claim 3, wherein the predetermined sequence of abutting truck and car tires is:

TC, TCC, TCCC, TCCCC, TCCCCC, TCCCCCC, TCCCCC, TCCCC, TCCC, TCC, TC.

5. The method of claim 1, wherein a multiple of the plurality of the discarded tires are truck tires, T, and wherein a multiple of the plurality of discarded tires are car tires, C, and wherein the plurality of discarded tires are placed in abutment in a predetermined sequence of abutting truck tires, T, and car tires, C, wherein the predetermined sequence of abutting tires is TC, TCC, TCCC, TCCCC, TCCCCC, TCCCCCC, TCCCCC, TCCCC, TCCC, TCC, TC, for the first 10 feet of the culvert as measured from a first edge of the first sidewall of the first tire.

6. A method for constructing a culvert of length, l, having a culvert central axis, the culvert made of n number of discarded vehicle tires, the vehicle tires having a first sidewall, a second sidewall, a vehicle tire central axis and tire treads, the method of constructing a culvert using discarded tires comprising the steps of:

a. separating and stacking a plurality of discarded vehicle tires b. creating a record of the plurality of discarded vehicle tires, wherein the record includes recording the condition of each one of the plurality of discarded tires, c. verifying the discarded tires, d. determining a stress point of the culvert, e. drilling three holes in the first sidewall of each of the plurality of discarded vehicle tires, wherein each of the three holes in the first sidewall are positioned equidistant from the other, f. drilling three holes in the second sidewall of each of the of the plurality of discarded vehicle tires, wherein each of the three holes are positioned equidistant from the other, g. arranging the plurality of discarded vehicle tires from a first discarded vehicle tire to an nth discarded vehicle tire, wherein each one of the plurality of discarded vehicle tires is in abutment with another one of the plurality of discarded vehicle tires, wherein the central axis of each one of the plurality of discarded vehicle tires is parallel to the central axis of the culvert, and wherein the holes in each sidewall of each one of the plurality of discarded tires are matched with the holes in another one of the plurality of discarded tires, and wherein at least one of the plurality of discarded vehicle tires is positioned to coincide with a culvert stress point, h. placing a first metal rod through at least one of the three holes drilled in the first sidewall of the first discarded vehicle tire, placing the first metal rod through at least one of the three holes drilled in the second sidewall of the first discarded vehicle tire, placing the first metal rod through at least one of the three holes drilled in the first sidewall of the nth discarded vehicle tire, placing the first metal rod through at least one of the three holes drilled in the second sidewall of the nth discarded vehicle tire, placing the first metal rod to include a first exposed first metal rod end through the at least one of the three holes drilled in the first side wall of the first discarded vehicle tire and placing the first metal rod to include a second exposed first metal rod end through the at least one of the holes drilled in the second sidewall of the nth discarded vehicle tire, i. placing a second metal rod through at least one of the three holes drilled in the first sidewall of the first discarded vehicle tire, placing the second metal rod through at least one of the three holes drilled in the second sidewall of the first discarded vehicle tire, placing the second metal rod through at least one of the three holes drilled in the first sidewall of the nth discarded vehicle tire, placing the second metal rod through at least one of the three holes drilled in the second sidewall of the nth discarded vehicle tire, placing the second metal rod to include a first exposed second metal rod end through the at least one of the three holes drilled in the first side wall of the first discarded vehicle tire and placing the second metal rod to include a second exposed second metal rod end through the at least one of the holes drilled in the second sidewall of nth discarded vehicle tire, j. placing a third metal rod through at least one of the three holes drilled in the first sidewall of the first discarded vehicle tire, placing the third metal rod through at least one of the three holes drilled in the second sidewall of the first tire, placing the third metal rod through at least one of the three holes drilled in the first sidewall of the nth discarded vehicle tire, placing the third metal rod through at least one of the three holes drilled in the second sidewall of the nth discarded vehicle tire placing the third metal rod to include a first exposed third metal rod end through the at least one of the three holes drilled in the first side wall of the first discarded vehicle tire and placing the third metal rod include a second exposed third metal rod end through the at least one of the holes drilled in the second sidewall of the nth discarded vehicle tire, k. placing a support plate in abutment with the second sidewall of the nth discarded vehicle tire, wherein the support plate is positioned to allow free movement of the second exposed first metal rod end through the at least one of the three holes drilled in the second sidewall of the nth discarded vehicle tire, wherein the support plate is positioned allow free movement of the second exposed second metal rod end through the at least one of the three holes drilled in the second sidewall of the nth discarded vehicle tire, and wherein the support plate is positioned to constrict the free movement of the second exposed third metal rod end through the at least one of the three holed drilled in the second sidewall of the third tire, l. affixing a first end of a wench cable to the support plate, wherein the first end of the wench cable is connected to the center mass of the support plate, and wherein the second end of the wench cable is attached to a wench, and wherein the wench cable is positioned parallel to the axis of the culvert, wherein the wench is affixed to a compression table, m. placing the first sidewall of the first discarded vehicle tire in abutment with compression table, n. compressing the first sidewall of the first discarded vehicle tire to the compression table, o. compressing the second sidewall of the first discarded vehicle tire against the first sidewall of the second tire, such that the second sidewall of the first tire creates a seal with the first sidewall of the second tire, p. bending the first exposed end of the first metal rod, such that the first exposed end of the first metal rod is bent parallel to the first sidewall of the first discarded vehicle tire to create a first metal rod first end sidewall constraint, q. bending the first metal rod first end sidewall constraint to be parallel to the first discarded vehicle tire treads, r. bending the second exposed end of the first metal rod, such that the second exposed end of the first metal rod is bent parallel to the second side wall of the nth discarded vehicle tire to create a first metal rod second end sidewall constraint, s. bending the first metal rod second end sidewall constraint to be parallel to nth discarded vehicle tire treads, t. bending a first exposed end of the third metal rod, such that the first exposed end of the third metal rod is bent parallel to the first sidewall of the first discarded vehicle tire to create a third metal rod first exposed end sidewall constraint, u. bending the third metal rod first exposed end sidewall constraint to be parallel to the first discarded vehicle tire treads, v. rotating the compression plate to allow free movement of the second exposed end of third metal rod, w. bending a second exposed end of the third metal rod, such that the second exposed end of the third metal rod is bent parallel to the second side wall of nth discarded vehicle tire to create a third metal rod second end sidewall constraint, x. bending the third metal rod second end sidewall constraint to be parallel to the nth discarded vehicle tire treads, y. decompressing the first tire and the second tire by releasing pressure on the wench cable, z. disconnecting the wench cable from the compression plate, wherein a multiple of the plurality of the discarded tires are truck tires, T, and wherein a multiple of the plurality of discarded tires are car tires, C, and wherein the plurality of discarded tires are placed in abutment in a predetermined sequence of abutting truck tires, T, and car tires, C, when the length of the culvert is at least 10 feet long, and wherein the predetermined sequence of abutting truck tire s and car tires is:

TC, TCC, TCCC, TCCCC, TCCCCC, TCCCCCC, TCCCCC, TCCCC, TCCC, TCC, TC.

7. The method of constructing a culvert according to claim 6, wherein the first tire is positioned in the culvert according to the culvert's stress point.

8. The method of claim 7, wherein a multiple of the plurality of the discarded tires are truck tires, T, and wherein a multiple of the plurality of discarded tires are car tires, C, and wherein the plurality of discarded tires are placed in abutment in a predetermined sequence of abutting truck tires, T, and car tires, C, wherein the predetermined sequence of abutting tires is TC, TCC, TCCC, TCCCC, TCCCCC, TCCCCCC, TCCCCC, TCCCC, TCCC, TCC, TC, for the first 10 feet of the culvert as measured from a first edge of the first sidewall of the first discarded vehicle tire.

9. The method of claim 7, wherein a multiple of the plurality of the discarded tires are truck tires, T, and wherein a multiple of the plurality of discarded tires are car tires, C, and wherein the plurality of discarded tires are placed in abutment in a predetermined sequence of abutting truck tires, T, and car tires, C, wherein the predetermined sequence of abutting tires is TC, TCC, TCCC, TCCCC, TCCCCC, TCCCCCC, TCCCCC, TCCCC, TCCC, TCC, TC, for every 10 feet of the culvert as measured from a first edge of the first sidewall of the first discarded vehicle tire.

10. The method of claim 7, wherein a multiple of the plurality of the discarded tires are truck tires, T, and wherein a multiple of the plurality of discarded tires are car tires, C, and wherein the plurality of discarded tires are placed in abutment in a predetermined sequence of abutting truck tires, T, and car tires, C, wherein the predetermined sequence of abutting tires is TC, TCC, TCCC, TCCCC, TCCCCC, TCCCCCC, TCCCCC, TCCCC, TCCC, TCC, TC, for 10 feet of the culvert as measured from a first edge of the first sidewall of the first discarded vehicle tire.

11. A method for constructing a culvert of length, l, having a culvert central axis, the culvert made of discarded vehicle tires, the vehicle tires having a first sidewall, a second sidewall, a vehicle tire central axis and tire treads, the method of constructing culvert comprising the steps of:

a. drilling three holes in the first sidewall of each of the plurality of discarded vehicle tires, wherein each hole is positioned equidistant from the other, b. drilling three holes in the second sidewall of each of the of the plurality of discarded vehicle tires, wherein each hole is positioned equidistant from the other, c. aligning the plurality of discarded vehicle tires from a first discarded vehicle tire to a last discarded vehicle tire, such that each one of the plurality of discarded vehicle tires is in abutment with at least one other of the plurality of discarded vehicle tires, wherein the central axis of each one of the plurality of discarded vehicle tires is parallel to the central axis of the culvert, and wherein the holes in each sidewall of each one of the plurality of discarded tires are matched with the holes in another one of the plurality of discarded tires, wherein a first discarded vehicle tire is positioned at a first end of the ordered plurality of discarded vehicle tires, wherein a second discarded vehicle tire is positioned at a second end of the ordered plurality of discarded vehicle tires, the first end of the ordered plurality of discarded vehicle tires being opposite the second end of the ordered plurality of discarded vehicle tires, d. placing a first metal rod through at least one of the three holes drilled in the first sidewall of each one of the plurality of discarded vehicle tires, placing the first metal rod through at least one of the three holes drilled in the second sidewall of each one of the plurality of discarded vehicle tires, e. placing a second metal rod through at least one of the three holes drilled in the first sidewall of each of the plurality of discarded vehicle tires, placing the second metal rod through at least one of the three holes drilled in the second sidewall of each one of the plurality of discarded vehicle tires, f. placing a third metal rod through at least one of the three holes drilled in the first sidewall of each of the plurality of discarded vehicle tires, placing the third metal rod through at least one of the three holes drilled in the second sidewall of each of the plurality of discarded vehicle tires, g. placing a support plate in abutment with the second sidewall of the second discarded vehicle tire, wherein the support plate is positioned to allow free movement of the second exposed first metal rod end through the at least one of the three holes drilled in the second sidewall of the second tire, wherein the support plate is positioned allow free movement of the second exposed second metal rod end through the at least one of the three holes drilled in the second sidewall of the second tire, and wherein the support plate is positioned to constrict the free movement of the second exposed third metal rod end through the at least one of the three holed drilled in the second sidewall of the third tire, h. affixing a first end of a wench cable to the support plate, wherein the first end of the wench cable is connected to the center mass of the support plate, and wherein the second end of the wench cable is attached to a wench, and wherein the wench cable is positioned parallel to the axis of the culvert, wherein the wench is affixed to a compression table, i. placing the first sidewall of the first discarded vehicle tire in abutment with compression table, j. compressing the first sidewall of the first discarded vehicle tire to the compression table, k. compressing the second sidewall of the first discarded vehicle tire against the first sidewall of the second tire, such that the second sidewall of the first tire creates a seal with the first sidewall of the second tire, l. bending the first exposed end of the first metal rod, such that the first exposed end of the first metal rod is bent parallel to the first sidewall of the first discarded vehicle tire to create a first metal rod first end sidewall constraint, m. bending the first metal rod first end sidewall constraint to be parallel to the first discarded vehicle tire treads, n. bending the second exposed end of the first metal rod, such that the second exposed end of the first metal rod is bent parallel to the second side wall of second discarded vehicle tire to create a first metal rod second end sidewall constraint, o. bending the first metal rod second end sidewall constraint to be parallel to the second discarded vehicle tire treads, p. bending a first exposed end of the third metal rod, such that the first exposed end of the third metal rod is bent parallel to the first sidewall of the first discarded vehicle tire to create a third metal rod first exposed end sidewall constraint, q. bending the third metal rod first exposed end sidewall constraint to be parallel to the first discarded vehicle tire treads, r. rotating the compression plate to allow free movement of the second exposed end of third metal rod, s. bending a second exposed end of the third metal rod, such that the second exposed end of the third metal rod is bent parallel to the second side wall of the second discarded vehicle tire to create a third metal rod second end sidewall constraint, t. bending the third metal rod second end sidewall constraint to be parallel to the second discarded vehicle tire treads, u. decompressing the first discarded vehicle tire and the second discarded vehicle tire by releasing pressure on the wench cable, v. disconnecting the wench cable from the compression plate.

12. The method of constructing a culvert according to claim 11, further including the step of determining the culvert's stress point.

13. The method of constructing a culvert according to claim 12, wherein the first tire is positioned in the culvert according to the culvert's stress point.

14. The method of claim 13, wherein a multiple of the plurality of the discarded tires are truck tires, T, and wherein a multiple of the plurality of discarded tires are car tires, C, and wherein the plurality of discarded tires are placed in abutment in a predetermined sequence of abutting truck tires, T, and car tires, C, when the length of the culvert is at least 10 feet long.

15. The method of claim 14, wherein the predetermined sequence of abutting truck and car tires is:

TC, TCC, TCCC, TCCCC, TCCCCC, TCCCCCC, TCCCCC, TCCCC, TCCC, TCC, TC.

16. The method of claim 14, wherein a multiple of the plurality of the discarded tires are truck tires, T, and wherein a multiple of the plurality of discarded tires are car tires, C, and wherein the plurality of discarded tires are placed in abutment in a predetermined sequence of abutting truck tires, T, and car tires, C, wherein the predetermined sequence of abutting tires is TC, TCC, TCCC, TCCCC, TCCCCC, TCCCCCC, TCCCCC, TCCCC, TCCC, TCC, TC, for the first 10 feet of the culvert as measured from a first edge of the first sidewall of the first tire.

* * * * *